United States Patent [19]

Stephens et al.

[11] 4,318,760

[45] Mar. 9, 1982

[54] SOLID PROPELLANT CONTAINING DIFERROCENYL KETONE

[75] Inventors: William D. Stephens, Vienna; Charles I. Ashmore, Reva, both of Va.

[73] Assignee: Atlantic Research Corporation, Alexandria, Va.

[21] Appl. No.: 77,438

[22] Filed: Sep. 20, 1979

[51] Int. Cl.[3] ..... C06B 45/10

[52] U.S. Cl. ..... 149/19.2; 149/19.9

[58] Field of Search ..... 149/19.2, 19.9

[56] References Cited

U.S. PATENT DOCUMENTS

| | | | |
|---|---|---|---|
| 3,666,575 | 5/1972 | Fisher | 149/19.2 |
| 4,023,994 | 5/1977 | Arendale | 149/19.2 |
| 4,108,696 | 8/1978 | Ashmore et al. | 149/19.2 |

OTHER PUBLICATIONS

Flanagan, "Combustion Mechanism of High Burning Rate Solid Propellants", Final Tech. Rep., AFRPL--TR-69-1, pp. Title-97 (Jan. 1969, Declassified 12-1978).

Thiokol, "Thermally Stable Burning Rate Accelerators", Final Report, Contract F04611-70-C-0066, pp. Title-170 (Jan. 1973, Declassified 12-1978).

Schaaf, Chem. Abs., 56, abs. #14325g-14327c (1962).

*Primary Examiner*—Edward A. Miller

*Attorney, Agent, or Firm*—Martha L. Ross

[57] ABSTRACT

A solid propellant composition comprising an organic polymer fuel binder, an inorganic perchlorate oxidizer salt, and 1,1″-carbonyl-bis-ferrocene which functions as a stable solid combustion modifier.

7 Claims, No Drawings

SOLID PROPELLANT CONTAINING DIFERROCENYL KETONE

BACKGROUND

The efficacy of ferrocene, a volatile red solid, as a burning rate accelerator in a solid composite propellant, was discovered in the early 1950's. It was found that ferrocene was superior to the metallic compounds, such as iron oxide, copper chromite and the like, then in use. Ferrocene, in equivalent amounts, gave much larger increases in burning rate and could be used effectively in increasingly higher concentrations with concomitant increase in burning rate.

Unfortunately propellants containing ferrocene undergo changes in composition with time due to volatility of the catalyst compound. This results in changes in both mechanical and ballistic properties during storage. Rocket motors containing ferrocene—catalyzed propellant grains were observed to have red needles of ferrocene sublimed and recrystallized on the grain surface.

Efforts were then turned to development of liquid ferrocene derivative catalysts having higher molecular weight and decreased volatility as compared with ferrocene. In addition to reducing the ferrocene volatility problem, the liquids improve processing properties by reducing the total amount of added solids and functioning as a plasticizer. However, two serious difficulties were encountered with the liquid ferrocene derivatives, crystallization and migration.

Crystallization of the liquid at low temperatures increases the solids content of the propellant above the design concentration and can, thereby, adversely affect mechanical properties.

The liquid also tends to diffuse from the propellant into the rubbery materials normally used in making the conventional liners employed with solid rocket propellant grains. This results in embrittlement of the propellant and undesirable modification of ballistic properties adjacent to the interface between the propellant and liner.

In view of these problems with ferrocene and liquid derivatives thereof, efforts have been made to find a solid ferrocene derivative replacement for the highly volatile ferrocene. To be successful, such a compound must meet several essential criteria. It must produce a substantial increase in burning rate of the propellant as compared with the non-catalyzed composition. It must be a stable, substantially non-volatile compound.

It must not adversely affect the physical or ballistic properties of the propellant composition in such terms, for example, as weight loss due to volatilization or decomposition at the environmental temperatures to which the propellant grain will be exposed, including substantially elevated temperatures; migration or diffusion; increase in propellant sensitivity to friction, impact or heat; production of ballistic unpredictability, such as variation in burning rate within the propellant grain; and the like.

A number of solid, relatively stable ferrocene derivatives have been tried as propellant burning rate accelerators. These include, for example, dimethyl polyferrocenyl methylene (DMPFM), a polymer produced by the reaction of ferrocene and acetone; 1,3-diferrocenyl-1-oxo-2 propene; 1,3-diferrocenyl-1,3-propanedione; and benzoyl ferrocene. DMPFM appeared to be one of the more promising solid ferrocene derivatives for use as a catalyst because of its stability per se and minimal adverse effects on propellant stability. However, it has been found to be inadequately effective as a burning rate accelerator. Other solid substantially stable ferrocene derivatives, which have been tried as propellant burning rate catalysts, produce grains having unacceptable physical and/or ballistic properties.

It has been suggested in the ferrocene derivative chemical art that a carbonyl group attached to the ferrocene moiety increases the thermal and oxidative stability of the compound. This, however, does not suggest the effect of a particular derivative when included in a propellant formulation.

Diferrocenyl ketone also known as 1,1″ -carbonyl-bis-ferrocene is a known chemical compound. It has not, however, been used or suggested for use as a propellant burning rate catalyst. Given the inadequacy of other solid ferrocenyl compounds as burning rate catalysts, it is surprising to find that diferrocenyl ketone is not only stable as a compound, but also substantially increases burning rate without adverse effects on the stability of the propellant.

SUMMARY OF THE INVENTION

Differocenyl ketone, a stable solid compound having a melting point of 225° C., when incorporated into a composite propellant comprising a synthetic organic polymer fuel and an inorganic perchlorate salt oxidizer, improves ballistic performance of the propellant by increasing burning rate and reducing pressure exponent. These desired results are achieved without adversely affecting the physical or ballistic properties of the propellant. The compound, which is substantially non-volatile and insoluble in the propellant matrix exhibits no appreciable tendency to evaporate, sublimate or volatize or to diffuse or migrate into propellant liner. Neither the ferrocenyl compound or the propellant composition shown phase change or decomposition over the useful temperature operating range of the propellant. Thus use of diferrocenyl ketone as a ballistic modifier achieves the desired improvement in burning rate and pressure exponent without undesirable catalyst migration or other adverse affect on propellant properties.

DESCRIPTION OF PREFERRED EMBODIMENTS

The diferrocenyl ketone can be used as a burning rate accelerator in substantially any composite propellant comprising an organic polymer fuel binder and an inorganic perchlorate salt oxidizer.

The organic polymer fuel binder useful in the invention can be substantially any such binder employed in the art. It can be, for example, polybutadiene and its derivatives such as hydroxy-or carboxy-substituted polybutadiene, polyurethane, polyethers, polyesters, polybutylenes, and the like. The polymer binder may or may not be plasticized with an organic plasticizer as is well known in the art. The preferred binders are the hydroxy-and carboxy-terminated polybutadienes. Since the use, processing, and cure of such binders are well known, they will not be discussed here.

The inorganic perchlorate oxidizer salt can be, for example, the alkali metal, e.g. Na, K, Li; alkaline earth metal e.g. Ca, Mg; or ammonium salts. Ammonium perchlorate is preferred.

Finely—divided metal fuels, such as Al, Mg, Zi, or the like may be added for high energy, high performance propellants.

Other additives, conventionally employed in the propellant art, can also be incorporated. These include, for example: cure catalysts to shorten cure time of the organic polymer; potlife extenders to extend the life of the precured composition; ballistic additives to modify burning rate at different pressures; and additives to improve physical, shelf life, or processing characteristics of the propellant.

The diferrocenyl ketone catalyst is effective for use in a wide range of propellant compositions—from high-energy to fuel-rich. The amount of catalyst incorporated is in minor proportion and may be as high as about 20%, preferably about 10%, with a minimum of about 0.1%. The specific concentration used is largely determined by the desired increase in burning rate.

The following examples illustrate the efficacy and improved properties of diferrocenyl ketone as compared with state-of-the-art ferrocene and liquid ferrocene derivative.

EXAMPLE 1

A. A solid propellant was prepared comprising 85.5% ammonium perchlorate (AP) 11% hydroxy-terminated polybutadiene, 1.5% combustion stabilizer additives, and 2% Catocene, a liquid ferrocene—derivative burning rate accelorator. This propellant had a burning rate of 1.32 in/sec at 1000 psia and a pressure exponent of 0.354.

B. An identical propellant was made except for substitution of the Catocene by 2% diferrocenyl ketone. The burning rate was 1.82 in/sec at 1000 psia and the pressure exponent was 0.431.

Propellant B was heated at 170° F. for 4 weeks. No evidence of volatility, sublimation, or evaporation was noted.

EXAMPLE 2

Two propellants similar to A and B in Example 1, except for a change in AP particle size were prepared. Propellant A containing the Catocene had a burning rate of 1.24 in/sec at 1000 psia and a pressure exponent of 0.385. Propellant B containing the diferrocenyl ketone had a burning rate of 1.25 in/sec at 1000 psia and a pressure exponent of 0.362.

Propellants A and B were cast against identical rubbery polymer liners and cured. The sample containing the solid diferrocenyl ketone was maintained at 170° F. for 4 weeks. After this time, concentration of the catalyst was measured at a distance of 0.050 in. into the propellant from the propellant-liner interface. Analysis showed no reduction in catalyst concentration, thereby demonstrating that no appreciable migration had occurred. The sample containing the liquid Catocene was maintained at 145° F. for two weeks. Concentration of the liquid catalyst within the propellant at 0.05 in distance from the propellant-liner interface was only 43% of the original value, thus demonstrating the large degree of migration of the catalyst from the propellant into the liner.

EXAMPLE 3

A. A solid, fuel-rich propellant was prepared comprising 37% AP, 23% carboxyterminated polybutadiene binder, 34% polystyrene bead fuel, 1% iron oxide, 2% combustion stabilizer additive, and 3% Catocene liquid. The propellant had a burning rate of 0.76 in/sec at 1000 psia and a pressure exponent of 0.09.

B. An identical propellant was made except for substitution of the Catocene by 3% diferrocenyl ketone. The burning rate was 0.64 in/sec at 1000 psia and the pressure exponent was 0.11.

C. An identical propellant was prepared except for the substitution of the catalysts of A and B by 3% ferrocene.

Propellant C was maintained at 52° C. for 4 weeks. Substantial propellant weight loss was observed. A large quantity of orange red needles had been produced by sublimation of the ferrocene from the propellant and recrystallization on cold surfaces nearby.

Propellant B containing the diferrocenyl ketone was maintained at 52° C. for 4 weeks. No propellant weight loss was found. There was no evidence of catalyst sublimation and recrystallization.

While the present invention has been described by specific embodiments thereof, it should not be limited thereto, since obvious modifications will occur to those skilled in the art without departing from the spirit of the invention or the scope of the claims.

We claim:

1. A solid propellant composition comprising an organic polymer fuel binder, an inorganic perchlorate oxidizer salt, and a minor proportion of 1,1″ -carbonyl-bis-ferrocene.

2. The propellant of claim 1 in which the perchlorate is alkali metal, alkaline earth metal or ammonioum salt.

3. The propellant of claim 2 in which the perchlorate is ammonium perchlorate.

4. The propellant of claim 2 in which the binder is hydroxyterminated polybutadiene.

5. The propellant of claim 3 in which the binder is hydroxyterminated polybutadiene.

6. The propellant of claim 2 in which the binder is carboxyterminated polybutadiene.

7. The propellant of claim 3 in which the binder is carboxyterminated polybutadiene.

* * * * *